US008021155B2

(12) United States Patent
Rasmussen

(10) Patent No.: US 8,021,155 B2
(45) Date of Patent: Sep. 20, 2011

(54) ROOFING PRODUCT DISPLAY AND METHOD

(75) Inventor: C. Scott Rasmussen, Ada, MI (US)

(73) Assignee: Quality Edge, Inc., Walker, MI (US)

( * ) Notice: Subject to any disclaimer, the term of this patent is extended or adjusted under 35 U.S.C. 154(b) by 273 days.

(21) Appl. No.: 12/461,000

(22) Filed: Jul. 28, 2009

(65) Prior Publication Data

US 2010/0019632 A1 Jan. 28, 2010

Related U.S. Application Data

(60) Provisional application No. 61/137,187, filed on Jul. 28, 2008.

(51) Int. Cl.
*G09B 25/00* (2006.01)

(52) U.S. Cl. ..... 434/74

(58) Field of Classification Search ..... 434/72, 434/73, 74, 79, 365, 367, 382, 402; 446/476, 446/478

See application file for complete search history.

(56) References Cited

U.S. PATENT DOCUMENTS

| | | | | |
|---|---|---|---|---|
| 910,240 | A | 1/1909 | Stecher | |
| 1,648,987 | A | 11/1927 | Griffes | |
| 1,668,428 | A | 5/1928 | Shope | |
| 2,005,034 | A | 6/1935 | Holt | |
| 2,214,987 | A | 9/1940 | Bolhuis | |
| 2,315,463 | A * | 3/1943 | Tingley et al. | 434/72 |
| 2,339,044 | A | 1/1944 | Barrett | |
| 2,635,359 | A * | 4/1953 | Broscious | 434/72 |
| 2,748,499 | A | 6/1956 | Shafer | |
| 2,951,311 | A | 9/1960 | Luther | |
| 3,838,527 | A | 10/1974 | Zucht | |
| 4,321,037 | A | 3/1982 | Miller | |
| 6,073,404 | A * | 6/2000 | Norfleet | 52/236.3 |
| 6,260,707 | B1 | 7/2001 | Harris | |
| 6,524,107 | B1 * | 2/2003 | Brown | 434/72 |
| 6,937,152 | B2 * | 8/2005 | Small | 340/568.1 |
| 7,156,663 | B1 | 1/2007 | Gerhart | |
| D575,509 | S * | 8/2008 | Evans | D3/271.6 |
| 2004/0224289 | A1 | 11/2004 | Brown | |
| 2009/0075560 | A1 * | 3/2009 | Smith et al. | 446/478 |

* cited by examiner

*Primary Examiner* — Kurt Fernstrom
(74) *Attorney, Agent, or Firm* — Prince Heneveld LLP

(57) ABSTRACT

A roofing product display and method has two miniature building halves with hollow interiors defined by interconnected sidewalls, pitched roof panels, transport bases and end panels, which are oriented at an angle to the associated transport bases. A hinge pivotally interconnects adjacent sides of the end panels to facilitate rotation of the miniature building halves between a folded storage position, wherein the roof panels come together in a generally straight plan configuration, and an unfolded display position, wherein the roof panels assume a generally L-shaped panel configuration with a roof valley therebetween. Roofing product samples are stored in the hollow building interiors, and are shaped for temporary placement on the roof panels in the display position to replicate installation on an actual building.

20 Claims, 7 Drawing Sheets

ROOFING PRODUCT DISPLAY AND METHOD

CROSS-REFERENCE TO RELATED APPLICATIONS AND CLAIM TO PRIORITY

The present application is related to a commonly assigned U.S. Provisional Patent Application Ser. No. 61/137,187, filed Jul. 28, 2008, entitled ROOFING PRODUCT DISPLAY, which is hereby incorporated herein by reference, and claims priority thereto under 35 U.S.C. §120.

BACKGROUND OF THE INVENTION

The present invention relates to product displays, and in particular to a product display for roofing products, such as drip edges, W-valleys, perimeter edge flashings, step flashings, gutters, gutter guards, shingle starters, shingles and the like.

Roofing products, such as drip edges, W-valleys, perimeter edge flashings, step flashings, gutters, gutter guards, shingle starters, shingles and the like, are commonly used in conjunction with building construction, and other roofing applications. Heretofore, fixed product displays have been available for the prospective purchasers to view such roofing products being applied to sample building sections. However, such prior displays are generally bulky, and not particularly effective in displaying the roofing products to potential customers.

Hence, it would be beneficial to provide an easily portable product display for roofing products, which accurately and realistically depicts or replicates installation of the same on an actual building.

SUMMARY OF THE INVENTION

One aspect of the present invention is a roofing product display kit, having first and second similarly configured miniature building halves shiftable between a folded storage position and an unfolded display position. Each miniature building half has in the display position a hollow interior defined by a vertical sidewall panel, a pitched roof panel fixedly connected with an upper portion of the sidewall panel, a vertical transport base panel fixedly connected with the sidewall panel and the roof panel along first side edges thereof, and a vertical end panel fixedly connected with the sidewall panel and the roof panel along second side edges thereof and oriented at a predetermined angle relative to the transport base panel in the range of 30 to 60 degrees. A hinge extends along and pivotally interconnects adjacent side edges of the end panels of the first and second miniature building halves to facilitate rotation of the miniature building halves between the folded storage position, wherein the transport base panels abut in a coplanar relationship and the roof panels come together in a generally straight plan configuration, and the unfolded display position, wherein the transport base panels are separated in an angular relationship and the roof panels assume a generally L-shaped plan configuration with a roof valley therebetween to facilitate placement of various roofing product samples thereon. A plurality of differently configured roofing product samples are provided, which are shaped for temporary placement on the roof panels in the display position to replicate installation on an actual building, and are stored in the hollow interiors of the first and second miniature building halves in the folded storage position.

Another aspect of the present invention is a roofing product display, having first and second similarly configured miniature building halves shiftable between a folded storage position and an unfolded display position. Each of the building half has in the display position a vertical sidewall panel, a pitched roof panel fixedly connected with an upper portion of the sidewall panel, a vertical transport base panel fixedly connected with the sidewall panel and the roof panel along first side edges thereof, and a vertical end panel fixedly connected with the sidewall panel and the roof panel along second side edges thereof and oriented at a predetermined angle relative to the transport base panel in the range of 30 to 60 degrees. A hinge extends along and pivotally interconnects adjacent side edges of the end panels of the first and second miniature building halves to facilitate rotation of the miniature building halves between the folded storage position, wherein the transport base panels abut in a coplanar relationship and the roof panels come together in a generally straight plan configuration, and the unfolded display position, wherein the transport base panels are separated in an angular relationship and the roof panels assume a generally L-shaped plan configuration with a roof valley therebetween to facilitate the temporary placement of various roofing product samples thereon to replicate installation on an actual building.

Yet another aspect of the present invention is a method for displaying roofing products, which includes forming first and second similarly configured miniature building halves, each with a hollow interior defined by a sidewall panel, a pitched roof panel fixedly connected with an upper portion of the sidewall panel, a transport base panel fixedly connected with the sidewall panel and the roof panel along first side edges thereof, and an end panel fixedly connected with the sidewall panel and the roof panel along second side edges thereof and oriented at a predetermined angle relative to the transport base panel in the range of 30 to 60 degrees. The method further includes pivotally interconnecting adjacent side edges of the end panels of the first and second miniature building halves to facilitate rotation of the miniature building halves between the folded storage position, wherein the transport base panels abut in a coplanar relationship and the roof panels come together in a generally straight plan configuration, and the unfolded display position, wherein the transport base panels are separated in an angular relationship and the roof panels assume a generally L-shaped plan configuration with a roof valley therebetween to facilitate the placement of various roofing product samples thereon. The method also includes providing a plurality of differently configured roofing product samples, and placing the roofing product samples in at least one of the hollow interiors of the first and second miniature building halves for storage therein. The method further includes pivotally shifting the first and second miniature building halves from the folded storage position to the unfolded display position, and removing at least one of the roofing product samples from the one interior of the first and second miniature building halves. The method further includes temporarily placing the one roofing product sample on at least one of the roof panels to replicate installation on an actual building, removing the one roof product sample from the one roof panel, and returning the same to the one interior of the first and second miniature building halves for storage. The method also includes pivotally shifting the first and second miniature building halves from the unfolded display position back to the folded storage position, and detachably locking the first and second miniature building halves together in the folded storage position. Finally, the method further includes pivotally shifting the locked first and second miniature building halves, with stored roofing product samples therein, to a transport position, wherein the transport base panels abuttingly support the folded first and second miniature building halves in a vertically upright fashion for transport to a remote location.

Yet another aspect of the present invention is to provide a unique roofing product display and related method which is easily transportable from one site to another, and conveniently stores roofing product samples within the interior thereof. Preferably, the roofing product samples are relatively short segments of full sized roofing products, so as to accurately and realistically depict or replicate installation on an actual building. The roofing product display has an uncomplicated design, and can be easily and quickly reconfigured without tools, even by unskilled personnel. The roofing product display is efficient in use, economical to manufacture, capable of a long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
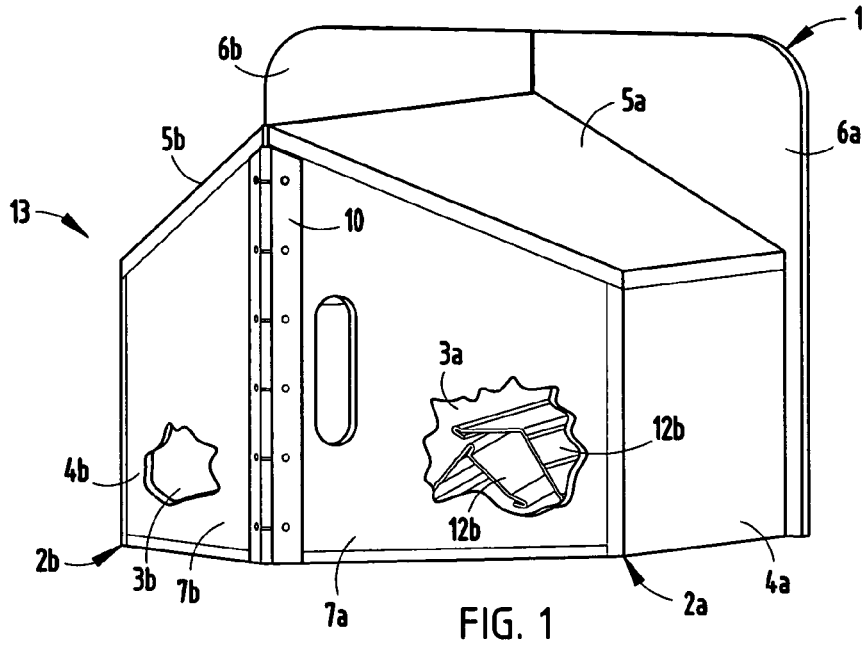
FIG. 1 is a perspective view of a roofing product display embodying the present invention, shown in a folded storage position, with a portion thereof broken away to reveal roofing product samples stored in the interior thereof.
Figure 2:
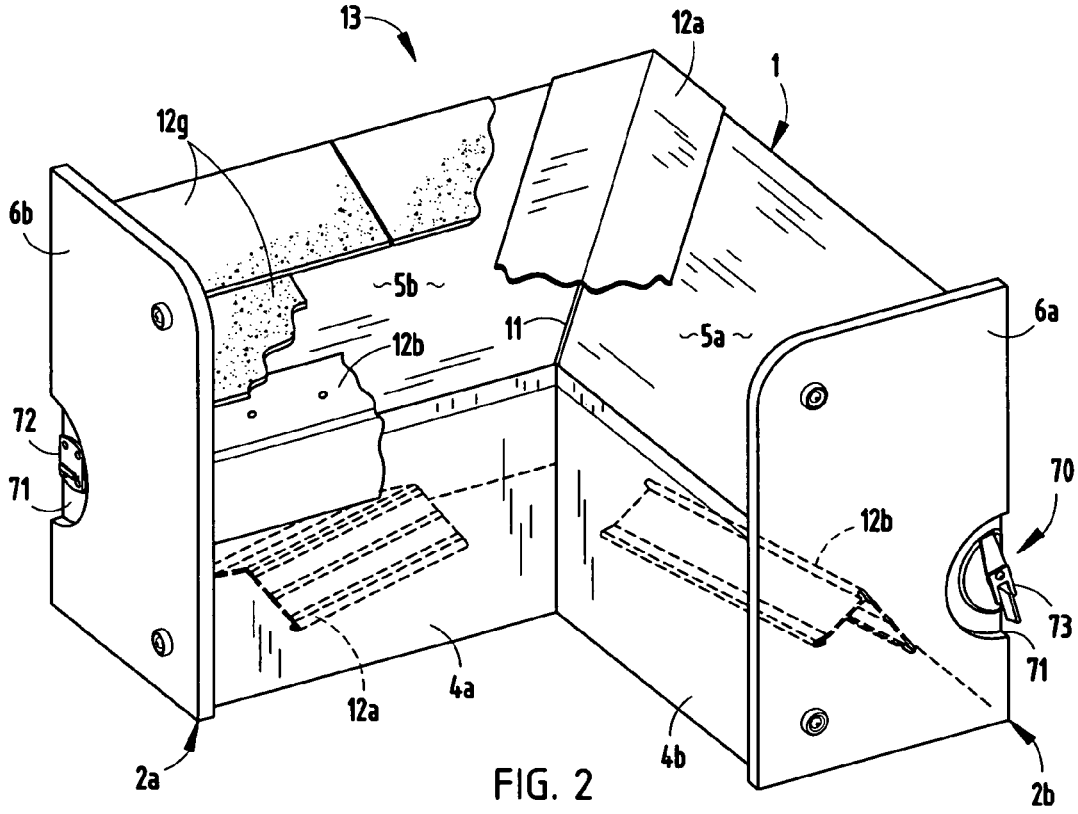
FIG. 2 is a perspective view of the roofing product display illustrated in FIG. 1, shown in an unfolded display position, with sample roofing positioned thereon.

For purposes of description herein, the terms "upper", "lower", "right", "left", "rear", "front", "vertical", "horizontal" and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As best illustrated in FIGS. 1 and 2, the illustrated roofing product display 1 includes first and second similarly configured miniature building halves 2*a*, 2*b*, which are shiftable between a folded storage position, as shown in FIG. 1, and an unfolded display position, as shown in FIG. 2. Each building half 2*a*,2*b* has in the display position (FIG. 2) a hollow interior 3*a*, 3*b* defined by a vertical sidewall panel 4*a*, 4*b*, a pitched roof panel 5*a*, 5*b* fixedly connected with an upper portion of sidewall panel 4*a*, 4*b*, a vertical transport base panel 6*a*, 6*b* fixedly connected with sidewall panel 4*a*, 4*b* and roof panel 5*a*, 5*b* along adjacent side edges thereof, and a vertical end panel 7*a*, 7*b* fixedly connected with sidewall panel 4*a*, 4*b* and roof panel 5*a*, 5*b* along opposite side edges thereof and oriented at a predetermined angle relative to the transport base panel 6*a*, 6*b* in the range of 30 to 60 degrees. A hinge 10 extends along and pivotally interconnects adjacent side edges of the end panels 7*a*, 7*b* of the first and second miniature building halves 2*a*, 2*b* to facilitate rotation of the miniature building halves 2*a*, 2*b* between the folded storage position (FIG. 1), wherein the transport base panels 6*a*, 6*b* abut in a coplanar relationship and the roof panels 5*a*, 5*b* come together in a generally straight plan configuration, and the unfolded display position (FIG. 2), wherein the transport base panels 6*a*, 6*b* are separated in an angular relationship and the roof panels 5*a*, 5*b* assume a generally L-shaped plan configuration with a roof valley 11 therebetween to facilitate placement of various roofing product samples thereon. A plurality of differently configured roofing product samples, such as the illustrated roofing product samples 12*a*-12*g*, are shaped for temporary placement on roof panels 5*a* and 5*b* in the display position (FIG. 2) to replicate installation on an actual building, and are stored in the hollow interiors 3*a*, 3*b* of the first and second miniature building halves 2*a*, 2*b* in the folded storage position (FIG. 1) to define a roofing product display kit 13.

Figure 3:
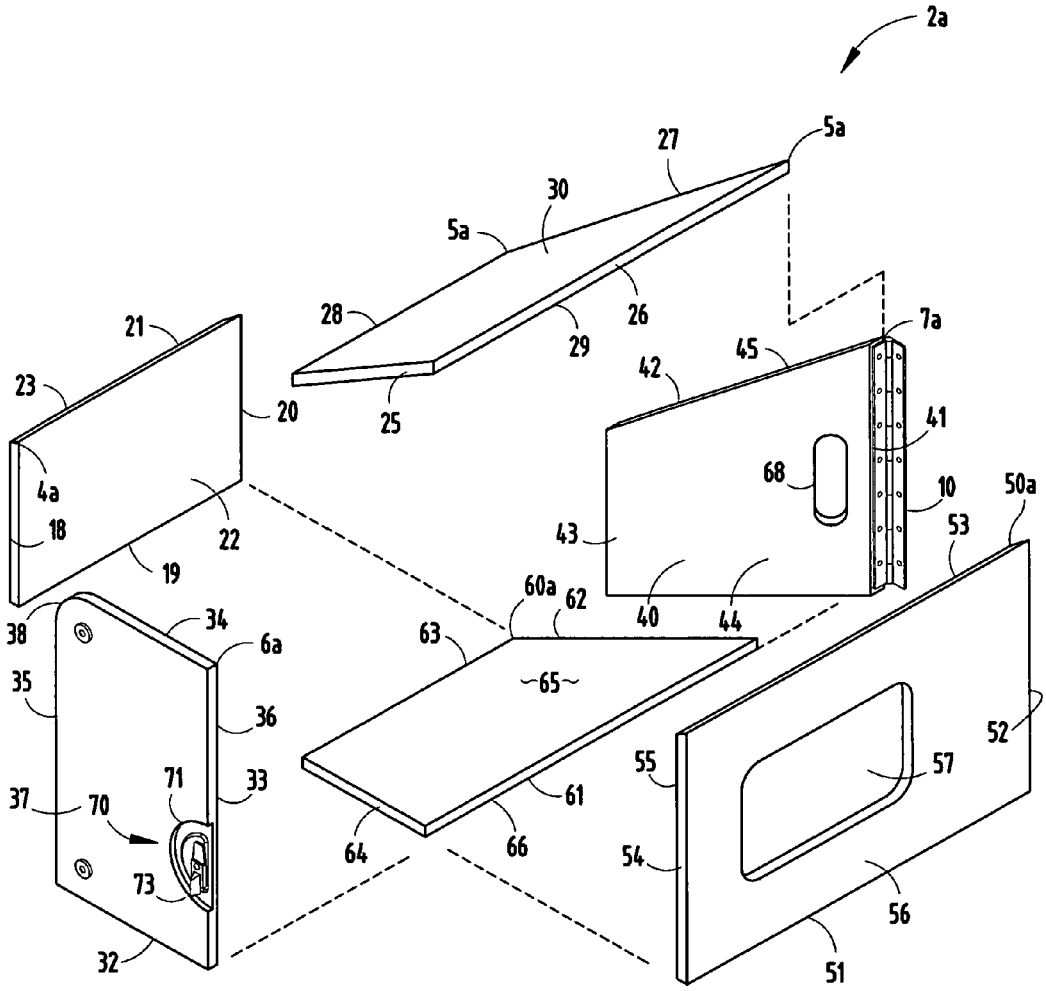
FIG. 3 is an exploded perspective view of a miniature building half portion of the roofing product display.
Figure 4:
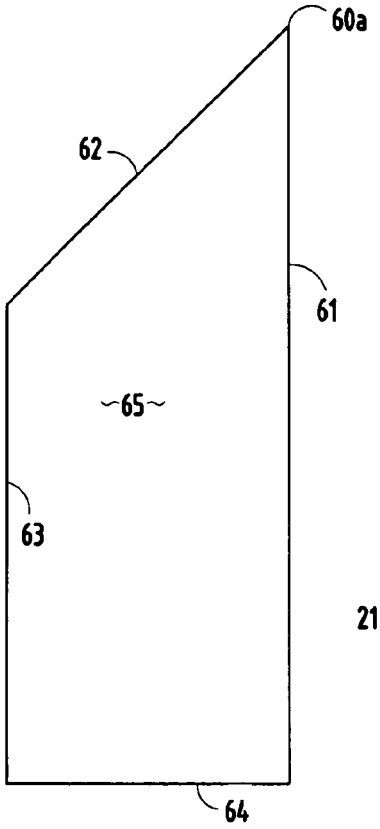
FIG. 4 is a plan view of a display base panel portion of the roofing product display.
Figure 6:
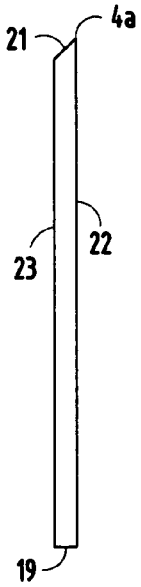
FIG. 6 is a top view of a sidewall panel portion of the roofing product display.
Figure 9:
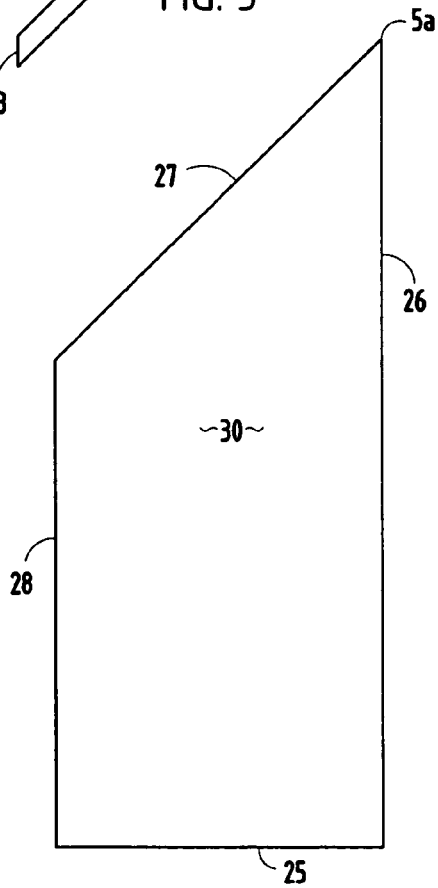
FIG. 9 is a plan view of a transport base panel portion of the roofing product display.

Since each of the miniature building halves 2*a*, 2*b* has a similar construction, the detailed description herein shall relate to building half 2*a*, with it being understood that building half 2*b* has similar parts and is similarly constructed. With reference to FIG. 3, the illustrated miniature building half 2*a* is constructed from six separate panels, which are mutually interconnected to define the hollow interior 3*a*. More specifically, the illustrated sidewall panel 4*a* (FIGS. 3 and 6) is a rectangularly-shaped, rigid, flat panel defined by straight side edges 18-21, as well as a flat interior face 22 and a flat exterior face 23 which is parallel therewith. The illustrated roof panel 5*a* (FIGS. 3 and 9) is a trapezoidally-shaped, rigid, flat panel defined by straight side edges 25-28, as well as a flat interior face 29 and a flat exterior face 30 which is parallel therewith. The illustrated transport base panel 6*a* (FIGS. 3 and 7) is a generally rectangularly-shaped, rigid, flat panel defined by straight side edges 32-35, as well as a flat interior face 36 and a flat exterior face 37 which is parallel therewith. The straight side edges 34 and 35 of transport base panel 6*a* are interconnected by a rounded corner 38. The illustrated end panel 7*a* is a trapezoidally-shaped, rigid, flat panel defined by straight side edges 40-43, as well as a flat interior face 44 and a flat exterior face 45 which is parallel therewith.

Each of the illustrated miniature building halve 2*a* also includes a center wall panel 50*a*, 50*b* which extends vertically in the display position (FIG. 2) and is fixedly connected with the associated roof panel 5*a*, 5*b*, the transport base panel 6*a*, 6*b* and the end panel 7*a*, 7*b* to define at least a portion of the hollows interiors 3*a*, 3*b* of the miniature building halves 2*a*, 2*b*. The illustrated center wall panel 50*a* (FIGS. 3 and 8) is a rectangularly-shaped, rigid, flat panel defined by straight side edges 51-54, as well as a flat interior face 55 and a flat exterior face 56 which is parallel therewith. Center wall panel 50*a* includes an access window 57, which extends completely through center wall panel 50*a*, and through which the roofing product samples 12*a*-12*g* are placed into and removed from the hollow interior 3*a* of the first miniature building half 2*a*. In the illustrated example, access window 57 has a generally rectangular shape and is located a spaced apart distance from edge 51, so as to ensure that the product samples 12*a*, 12*b* and 12*c* are securely captured within the interior 3*a* of building half 2*a*.

Each of the illustrated miniature building halves 2*a*, 2*b* also includes a display base 60*a*, 60*b* oriented generally horizontally in the display position (FIG. 2) and fixedly connected with the associated sidewall panel 4*a*, 4*b*, end panel 7*a*, 7*b*, transport base panel 6*a*, 6*b* and center wall panel 50*a*, 50*b* to define at least a portion of the hollow interiors 3*a*, 3*b* of the miniature building halves 2*a*, 2*b*. The illustrated display base panel 60*a* is a trapezoidally-shaped, rigid, flat panel defined by straight side edges 61-64, as well as a flat interior face 65 and a flat exterior face 66 which is parallel therewith.

Figure 5:
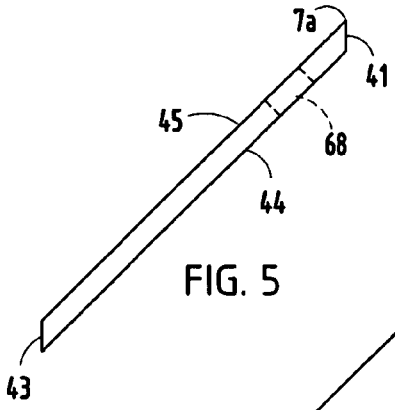
FIG. 5 is a top view of an end panel portion of the roofing product display.
Figure 8:
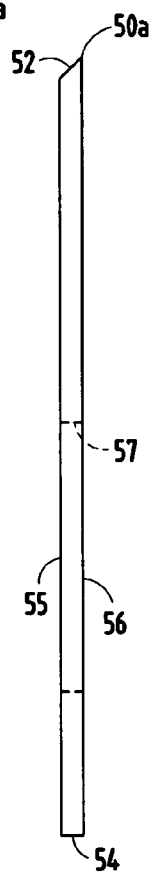
FIG. 8 is a top view of a center wall panel portion of the roofing product display.
Figure 7:
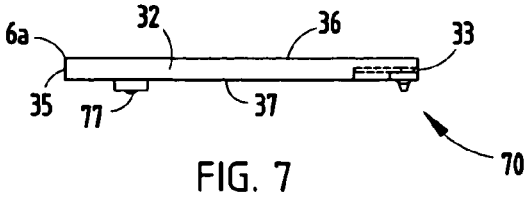
FIG. 7 is a side view of a display base panel portion of the roofing product display.
Figure 10:
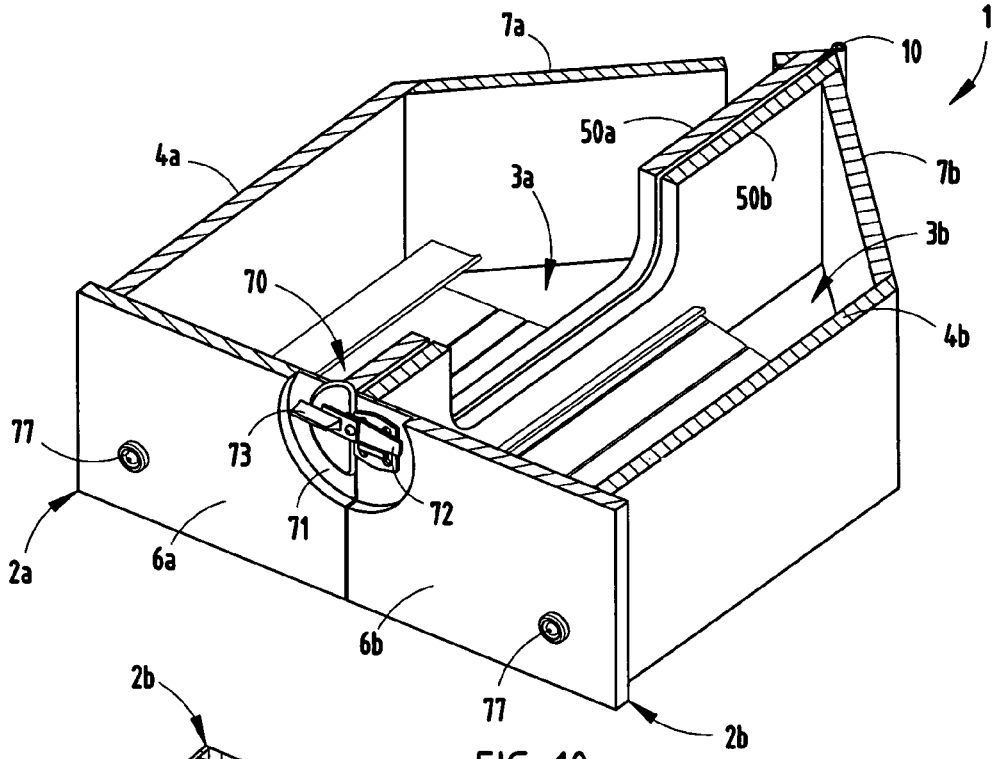
FIG. 10 is a horizontal cross-sectional view of the roofing product display, shown in the folded storage position.

As best illustrated in FIG. 3, the edge 19 of sidewall panel 4*a* is attached to the side edge 63 of display base 60*a*. The edge 40 of end panel 7*a* is attached to the edge 62 of display base 60*a*. The edge 51 of center wall panel 50*a* is attached to the edge 61 of display base 60*a*. The edge 32 of transport base panel 6*a* is attached to the edge 64 of display base 60*a*. Furthermore, the side edge 20 of sidewall panel 4*a* is attached to the side edge 43 of end panel 7*a*, and the opposite edge 18 of sidewall panel 4*a* is attached to the interior face 36 of transport base panel 6*a*. The outside edge 35 of transport base panel 6*a* protrudes outwardly from the exterior face 23 of sidewall panel 4*a* to provide a secure footing for supporting the roofing product display 1 in the transport position (FIGS. 7 and 8). The side edge 52 of center wall panel 50*a* is attached to the side edge 41 of end panel 7*a*, and the opposite side edge 54 of center wall panel 50*a* is attached to the interior face 36 of transport base panel 6*a* alongside edge 33. The forward edge 27 of roof panel 5*a* is attached to the upper edge 42 of end panel 7*a*, and the rear edge 35 of roof panel 5*a* is attached to the interior face 36 of transport base panel 6*a*. The illustrated end panel 7*a* (FIGS. 3 and 5) includes an elongated, obround-shaped aperture 68 which is adapted for manual grasping, and defines an integral or built-in handle which facilitates transporting roofing product display 1 in the transport position (FIGS. 16 and 17), as discussed below. As noted above, each of the miniature building halves 2*a* and 2*b* is similarly constructed from similar panels.

Figure 11:
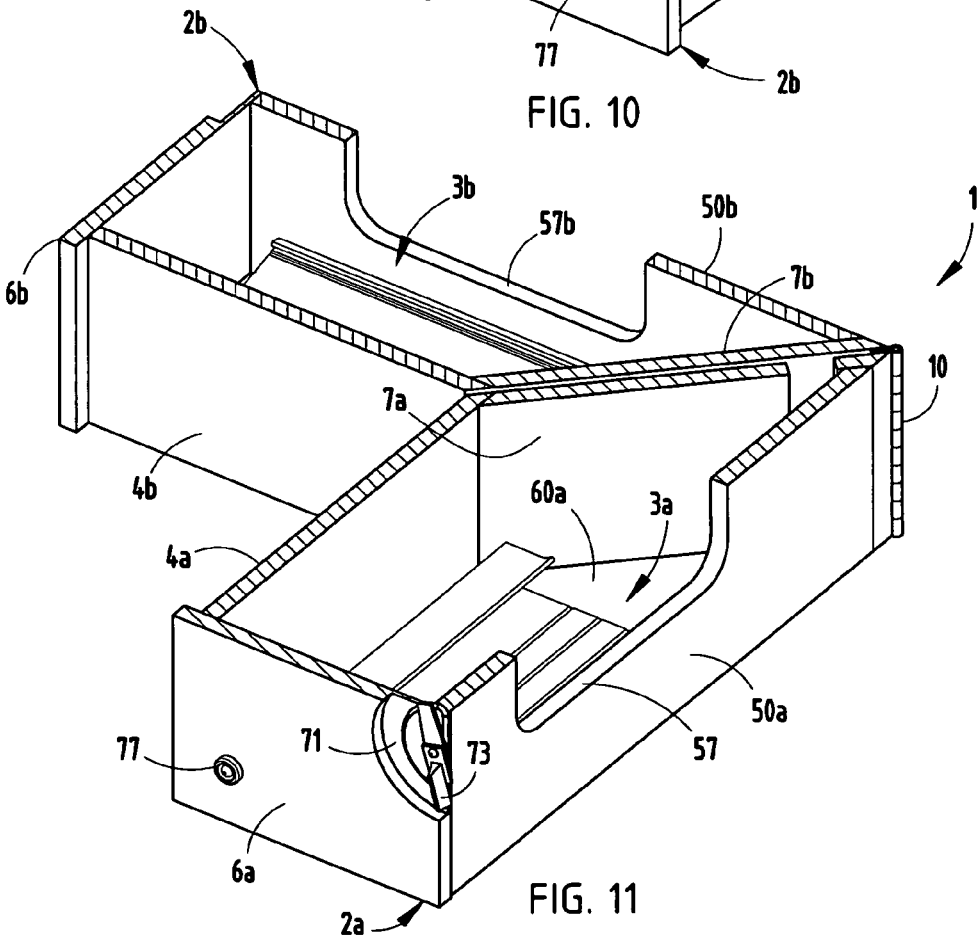
FIG. 11 is a horizontal cross-sectional view of the roofing product display, shown in the unfolded display position.
Figure 15:
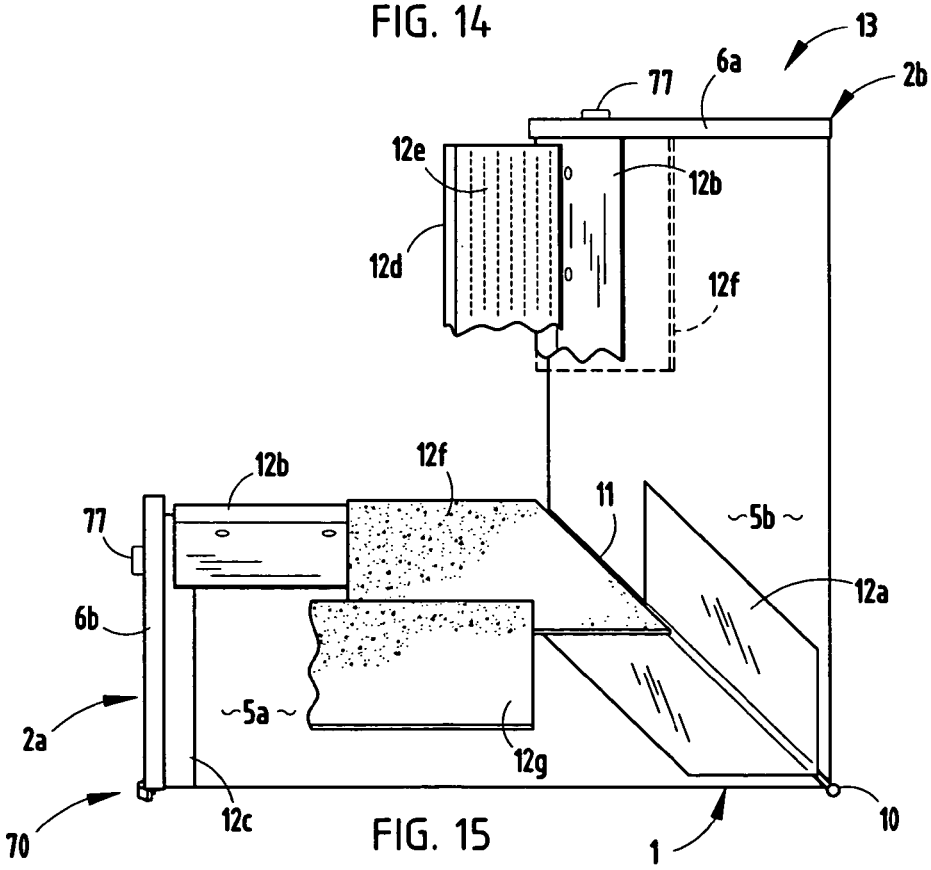
FIG. 15 is a top plan view of the roofing product display, shown in the unfolded display position, with sample roofing products positioned thereon.

As best illustrated in FIGS. 10, 11, 14 and 15, the end panels 7*a*, 7*b* are oriented at a predetermined angle relative to their associated transport base panels 6*a*, 6*b*, as well as relative to each other. More specifically, end panels 7*a*, 7*b* are preferably each oriented at an angle in the range of 30-60 degrees relative to their associated transport base panels 6*a*, 6*b* (FIG. 15), such that when miniature building halves 2*a* and 2*b* are rotated into the unfolded display position (FIGS. 2, 11 and 15), the exterior faces 45 of end panels 7*a*, 7*b* abut, and a typical building roof trough or valley 11 is formed in roof panels 5*a*, 5*b* along the angled edges 27 of roof panels 5*a*, 5*b*. In the illustrated example, the end panels 7*a*, 7*b* are oriented at an angle of around 45 degrees relative to their associated transport base panels 6*a*, 6*b* and their associated center wall panels 50*a*, 50*b*. With reference to FIG. 3, the angled edge 42 of the end panel 7*a* is oriented at an angle of around 45 degrees relative to side edge 41 and 135 degrees relative to side edge 43. In the folded storage position (FIGS. 1, 10, 12 and 14), the sidewall panel 4*a* of miniature building half 2*a* is oriented 135 degrees from the sidewall panel 4*b* of miniature building half 2*b*, such that miniature building halves 2*a*, 2*b* are pivoted around 135 degrees about hinge 10 between the folded storage position (FIGS. 1, 10, 12 and 14) and the unfolded display position (FIGS. 2, 11 and 15).

The illustrated hinge 10 is a conventional piano hinge, preferably constructed from a rust-resistant material, and as best shown in FIGS. 1 and 3, extends along and is attached to the inside edges 41 of end panels 7*a* and 7*b* to facilitate rotation of the miniature building halves 2*a*, 2*b* between the folded storage position (FIG. 1) and the unfolded display position (FIG. 2).

As best illustrated in FIGS. 3 and 10-12, a latch 70 is mounted on the exterior faces 37 of transport bases 6*a*, 6*b*, and is configured to selectively, yet positively, retain the first and second miniature building halves 2*a*, 2*b* locked in the folded storage position (FIG. 1). In the illustrated example, latch 70 is in the nature of double hung window latch, which is mounted in a circular recess 71 formed in the exterior faces 37*a*, 37*b* of transport base panels 6*a*, 6*b*. The fixed catch 72 of latch 70 is mounted in one half of the recess 71, while the pivoting latch 73 is mounted in the opposite half of recess 71. Rotation of movable latch 73 locks and unlocks the building halves 2*a* and 2*b*, so as to prevent and/or permit rotation of the same about hinge 10. As best illustrated in FIGS. 1 and 3, latch 70 is preferably fully recessed in recess 71, so as to avoid interference with the ground when roofing product display 1 is shifted into the upright transport position shown in FIGS. 16 and 17.

Figure 12:
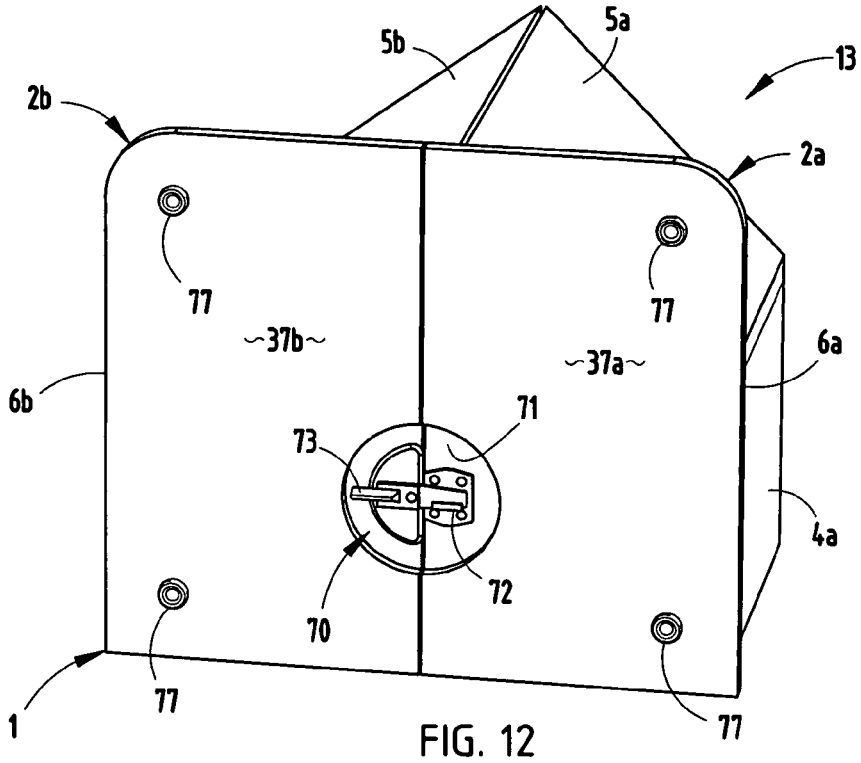
FIG. 12 is a perspective view of the roofing product display, shown locked in the folded storage position, and taken from a rear side thereof.
Figure 13:
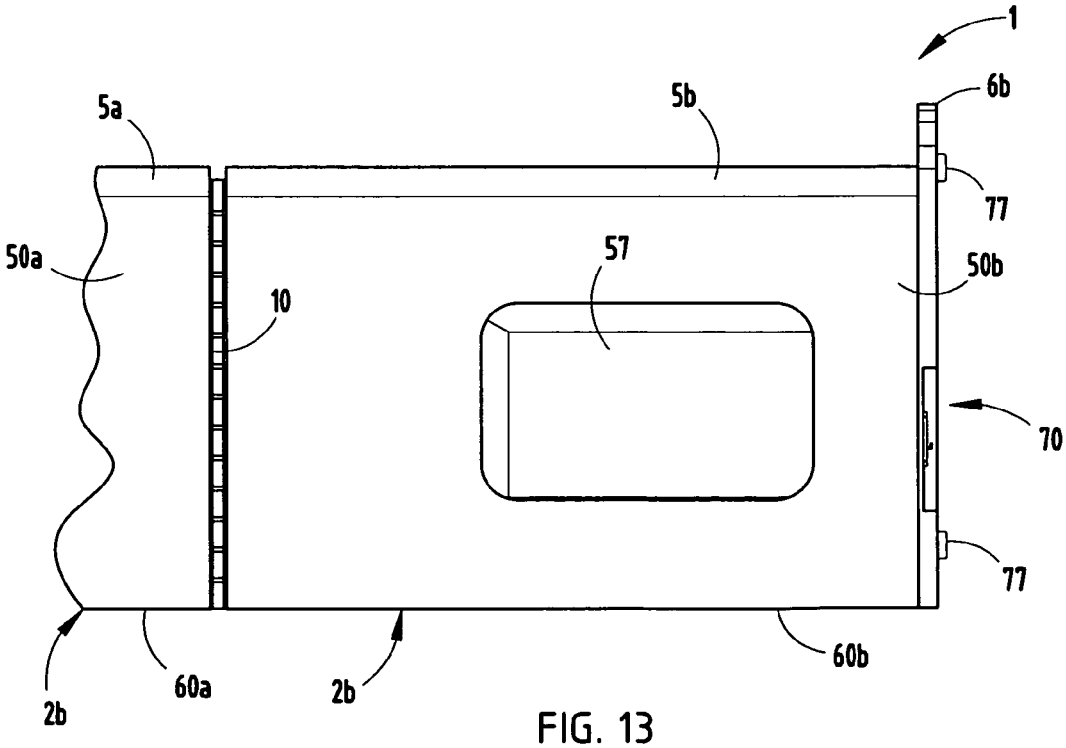
FIG. 13 is a fragmentary side elevational view of the roofing product display, shown in the unfolded display position, and taken from a rear side thereof.
Figure 14:
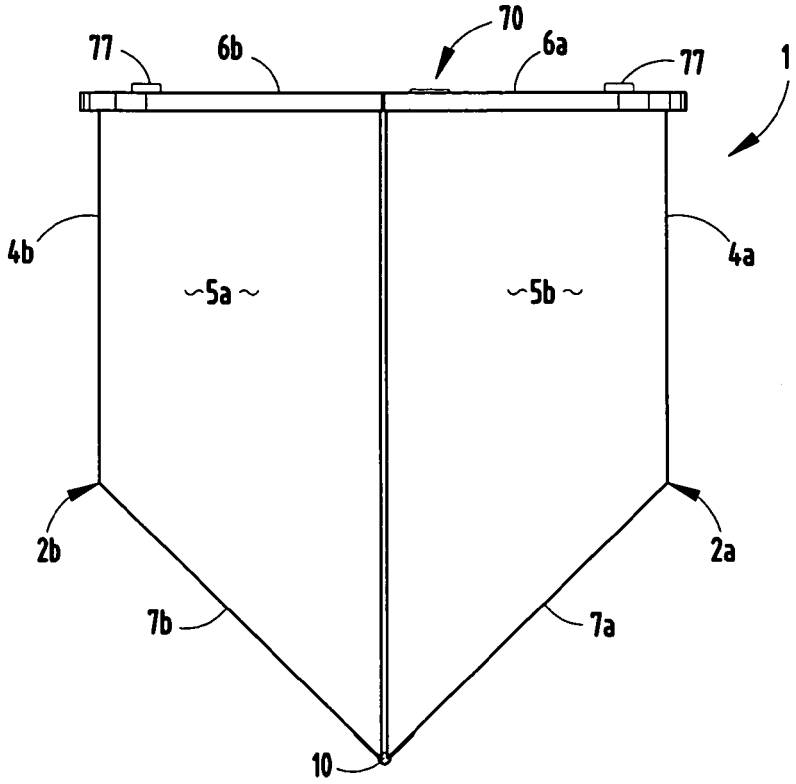
FIG. 14 is a top plan view of the roofing product display, shown in the folded storage position.
Figure 16:
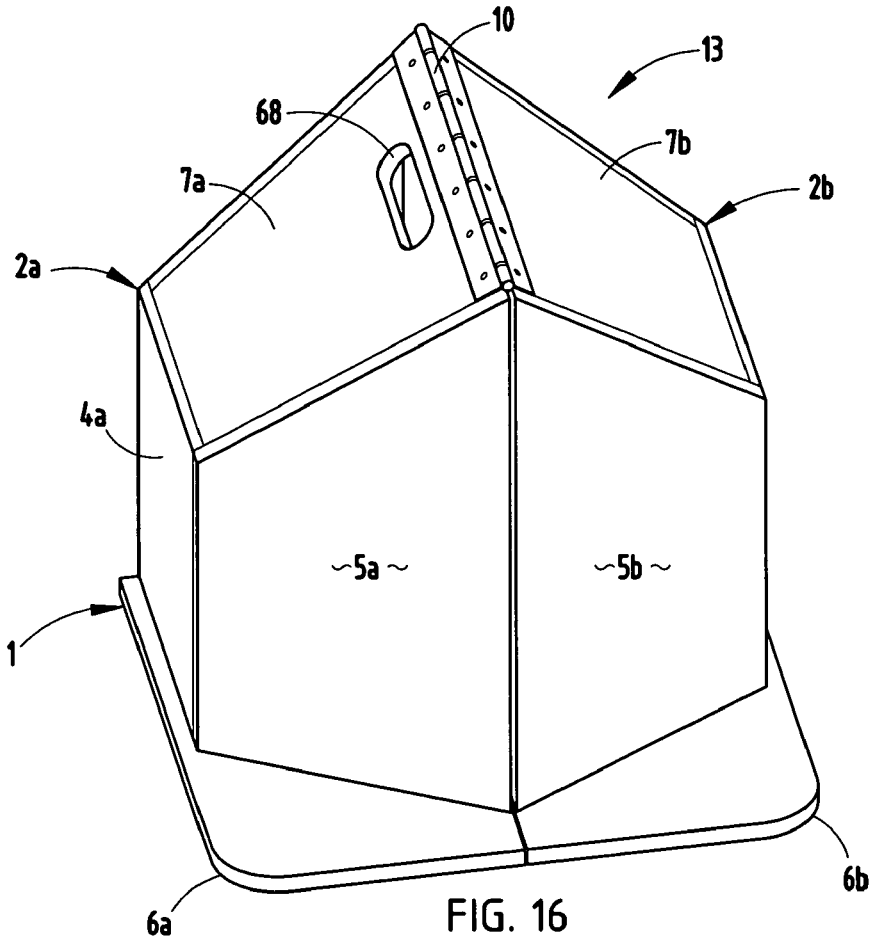
FIG. 16 is a perspective view of the roofing product display, shown in a transport position, with the miniature building halves locked together in the folded position.
Figure 17:
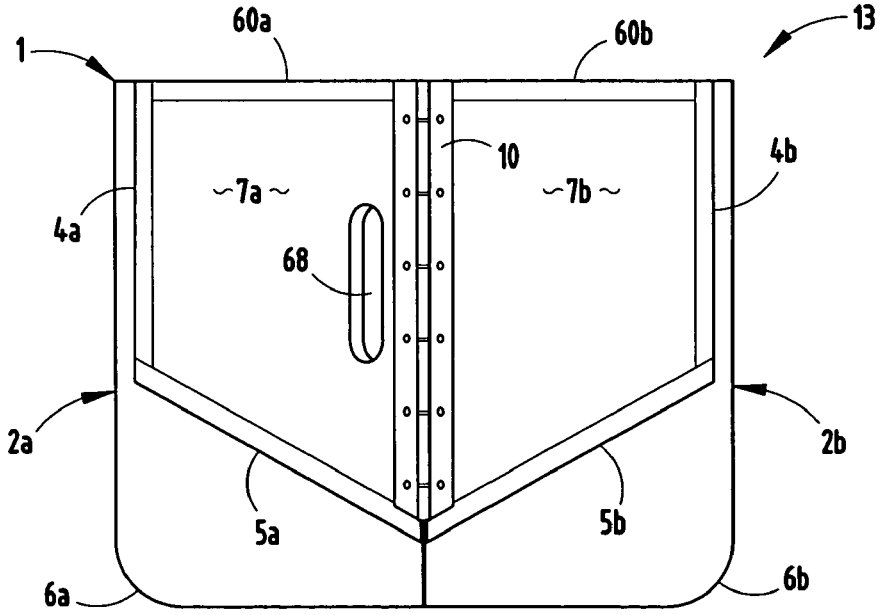
FIG. 17 is a top plan view of the roofing product display, shown in the transport position.

As best illustrated in FIGS. 2 and 12, the illustrated miniature building halves 2*a*, 2*b* also include a plurality of feet 77 mounted on the exterior faces 37*a*, 37*b* of transport base panel 6*a*, 6*b* adjacent opposite corners thereof. Feet 77 protrude outwardly from the exterior surfaces of transport base panel 6*a* and support the roofing product display 1 in an upright orientation on a support surface to define the transport position, as illustrated in FIGS. 16 and 17.

The illustrated roofing product samples 12*a*-12*g* include relatively short sections or lengths of full sized roofing products, including W-valleys 12*a*, drip edges 12*b*, perimeter edge flashings 12*c*, gutters 12*d* and gutter protection devices 12*e*, such as those disclosed in U.S. Pat. Nos. 6,993,870; 6,931,792; 7,137,224 and D559,957 which are incorporated herein by reference, as well as starter shingles 12*f*, shingles 12*g* and other similar roofing products, including step flashings and shingle starters (not shown).

In operation, the roofing product samples 12*a*-12*g* are stored in the interiors 3*a*, 3*b* of miniature building halves 2*a*, 2*b* by simply inserting the same through the access windows 57 in the associated center wall panels 50*a*, 50*b*. With the miniature building halves 2*a*, 2*b* folded together and locked with latch 70, the roofing product display 1 is typically transported in the display position illustrated in FIGS. 16 and 17, wherein feet 77 are oriented downwardly and abut an associated support surface, and integral handle 68 is oriented upwardly for easily grasping the roofing product display 1 for manual transport. To use the roofing product display 1 at a particular location, the same is placed on a support surface in the upright transport position (FIGS. 16 and 17), and pivoted downwardly 90 degrees out of the transport position to the folded storage position shown in FIGS. 1, 10, 12 and 14, wherein the exterior faces 66 of display bases 60*a*, 60*b* are supported on the support surface. Latch 70 is unlocked by rotation of pivoting latch 73, and the miniature building halves 2*a*, 2*b* are then mutually rotated about hinge 10 to the unfolded display position shown in FIGS. 2, 11 and 15, wherein the transport base panels 6*a*, 6*b* are separated in an angular relationship, and the roof panels 5*a*, 5*b* assume a generally L-shaped plan configuration with the roof valley 11 therebetween to facilitate placement of various roofing product samples 12*a*-12*g* thereon. The unfolding of building halves 2*a*, 2*b* to the unfolded display position-automatically opens or provides access to the roofing product samples 12*a*-12*g* through the access windows 57 in center wall panels 50*a*, 50*b*. The salesperson then removes the selected roofing product samples 12*a*-12*g* from the interiors 3*a*, 3*b* of the miniature building halves 2*a*, 2*b*, and places the same on and/or along the roof panels 5*a*, 5*b* in the unfolded display position, as shown in FIGS. 2 and 15, so as to replicate installation on an actual building. Since at least roofing products samples 12*a*, 12*b* and 12*c* are full sized, they provide an accurate visualization and replication of installation on an actual building. When the sale representation is completed, the roofing product samples 12*a*-12*g* are returned to storage in the interiors 3*a*, 3*b* of the miniature building halves 2*a*, 2*b* through insertion of the same through access windows 57 in center wall panels 50*a*, 50*b*. The roofing product display 1 is then returned to the folded display position (FIGS. 1, 10 and 12) by rotating miniature building halves 2*a*, 2*b* on display bases 60*a*, 60*b* about hinge 10. Latch 70 is then locked by rotation of pivoting latch 73, and the folded and locked miniature building halves 2*a*, 2*b* are pivoted 90 degrees, which shifts the roofing product display 1 to the upright transport position illustrated in FIGS. 16 and 17.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is as follows:

1. A roofing product display kit, comprising:

first and second similarly configured miniature building halves shiftable between a folded storage position and an unfolded display position, each having in said display position a hollow interior defined by a vertical sidewall panel, a pitched roof panel fixedly connected with an upper portion of said sidewall panel, a vertical transport base panel fixedly connected with said sidewall panel and said roof panel along first side edges thereof, and a vertical end panel fixedly connected with said sidewall panel and said roof panel along second side edges thereof and oriented at a predetermined angle relative to said transport base panel in the range of 30-60 degrees;

a hinge extending along and pivotally interconnecting adjacent side edges of said end panels of said first and second miniature building halves to facilitate rotation of said miniature building halves between said folded storage position, wherein said transport base panels abut in a coplanar relationship and said roof panels come together in a generally straight plan configuration, and said unfolded display position, wherein said transport base panels are separated in an angular relationship and said roof panels assume a generally L-shaped plan configuration with a roof valley therebetween to facilitate placement of various roofing samples thereon; and a plurality of differently configured roofing product samples shaped for temporary placement on said roof panels in said display position to replicate installation on an actual building, and storage in said hollow interiors of said first and second miniature building halves in said folded storage position.

2. A roofing product display kit as set forth in claim 1, wherein:

each of said first and second miniature building halves includes a center wall panel extending vertically in said display position and fixedly connected with said roof panel, said transport base panel and said end panel to define at least a portion of said hollow interiors of said first and second miniature building halves; and at least one of said center wall panels includes an aperture through which said roofing product samples are placed into and removed from said hollow interiors of said first and second miniature building halves.

3. A roofing product display kit as set forth in claim 2, including:

a latch mounted on said transport base panels and configured to selectively, yet positively, retain said first and second miniature building halves in said folded storage position.

4. A roofing product display kit as set forth in claim 3, including:

a plurality of feet mounted on exterior faces of said transport base panels and supporting said roofing product display kit in an upright orientation on a support surface to define a transport position.

5. A roofing-product display kit as set forth in claim 4, including:

a handle shaped for manual grasping and disposed on said first and second miniature building halves at a location thereon generally opposite to said feet to facilitate manual transport of said roofing product display kit in said transport position.

6. A roofing product display kit as set forth in claim 5, wherein:

said predetermined angle of said end panels is substantially 45 degrees, such that in said unfolded display position, said first and second building halves assume a generally perpendicular relationship.

7. A roofing product display kit as set forth in claim 6, wherein:

each of said first and second miniature building halves includes a display base oriented generally horizontally in said display position and fixedly connected with said sidewall panel, said end panel, said transport base panel and said center wall panel to define at least a portion of said hollow interiors of said first and second miniature building halves.

8. A roofing product display, comprising:

first and second similarly configured miniature building halves shiftable between a folded storage position and an unfolded display position, each having in said display position a vertical sidewall panel, a pitched roof panel fixedly connected with an upper portion of said sidewall panel, a vertical transport base panel fixedly connected with said sidewall panel and said roof panel along first side edges thereof, and a vertical end panel fixedly connected with said sidewall panel and said roof panel along second side edges thereof and oriented at a predetermined angle relative to said transport base panel in the range of 30-60 degrees; and a hinge extending along and pivotally interconnecting adjacent side edges of said end panels of said first and second miniature building halves to facilitate rotation of said miniature building halves between said folded storage position, wherein said transport base panels abut in a coplanar relationship and said roof panels come together in a generally straight plan configuration, and said unfolded display position, wherein said transport base panels are separated in an angular relationship and said roof panels assume a generally L-shaped plan configuration with a roof valley therebetween to facilitate the temporary placement of various roofing product samples thereon to replicate installation on an actual building.

9. A roofing product display as set forth in claim 8, wherein:

each of said first and second miniature building halves includes a center wall panel extending vertically in said display position and fixedly connected with said roof panel, said transport base panel and said end panel to define at least a portion of said hollow interiors of said first and second miniature building halves; and at least one of said center wall panels includes an aperture through which the roofing product samples are placed into and removed from said hollow interiors of said first and second miniature building halves.

10. A roofing product display as set forth in claim 8, including:

a latch mounted on said transport base panels and configured to selectively, yet positively, retain said first and second miniature building halves in said folded storage position.

11. A roofing product display as set forth in claim 8, including:

a handle shaped for manual grasping and disposed on said first and second miniature building halves at a location thereon generally opposite to said transport base panels to facilitate manual transport of said roofing product display in an upright transport position.

12. A roofing product display as set forth in claim 8, including:

a plurality of feet mounted on exterior faces of said transport base panels and supporting said roofing product display in an upright orientation on a support surface to define a transport position.

13. A roofing product display as set forth in claim 8, wherein:

said predetermined angle of said end panels is substantially 45 degrees, such that in said unfolded display position, said first and second building halves assume a generally perpendicular relationship.

14. A roofing product display as set forth in claim 8, wherein:

each of said first and second miniature building halves includes a display base oriented generally horizontally in said display position and fixedly connected with said sidewall panel, said end panel, said transport base panel and said center wall panel to define at least a portion of said hollow interiors of said first and second miniature building halves.

15. A method for displaying roofing products, comprising:

forming first and second similarly configured miniature building halves, each with a hollow interior defined by a sidewall panel, a pitched roof panel fixedly connected with an upper portion of the sidewall panel, a transport base panel fixedly connected with the sidewall panel and the roof panel along first side edges thereof, and an end panel fixedly connected with the sidewall panel and the roof panel along second side edges thereof and oriented at a predetermined angle relative to the transport base panel in the range of 30-60 degrees;

pivotally interconnecting adjacent side edges of the end panels of the first and second miniature building halves to facilitate rotation of the miniature building halves between a folded storage position, wherein the transport base panels abut in a coplanar relationship and the roof panels come together in a generally straight plan configuration, and an unfolded display position, wherein the transport base panels are separated in an angular relationship and said roof panels assume a generally L-shaped plan configuration with a roof valley therebetween to facilitate placement of various roofing samples thereon;

providing a plurality of differently configured roofing product samples;

placing the roofing product samples in at least one of the hollow interiors of the first and second miniature building halves for storage therein;

pivotally shifting the first and second miniature building halves from the folded storage position to the unfolded display position;

removing at least one of the roofing products samples from the one interior of the first and second miniature building halves;

temporarily placing the one roofing product sample on at least one of the roof panels to replicate installation on an actual building;

removing the one roofing product sample from the one roof panel and returning the same to the one interior of the first and second miniature building halves for storage;

pivotally shifting the first and second miniature building halves from the unfolded display position back to the folded storage position;

detachably locking the first and second miniature building halves in the folded storage position; and pivotally shifting the locked first and second miniature building halves with stored roofing product samples therein to a transport position wherein the transport base panels abuttingly support the folded first and second miniature building halves in a vertically upright fashion for transport to a remote location.

16. A method as set forth in claim 15, including:

forming an aperture through one of the roof panels to define a handle suitable for manual grasping to facilitate transport of first and second miniature building halves and roofing product samples in the transport position.

17. A method as set forth in claim 16, including:

mounting a plurality of laterally spaced apart feet on exterior faces of the transport base panels.

18. A method as set forth in claim 17, including:

forming the predetermined angle of the sidewall panels at substantially 45 degrees, such that in the unfolded display position, the first and second building halves assume a generally perpendicular relationship.

19. A method as set forth in claim 18, including:

forming each of the first and second miniature building halves with a center wall panel which extends vertically in the display position and is fixedly connected with the roof panel, the transport base panel and the end panel to define at least a portion of the hollow interiors of the first and second miniature building halves; and forming an aperture through at least one of the center wall panels through which the roofing product samples are places into and removed from the hollow interiors of the first and second miniature building halves.

20. A method as set forth in claim 19, including:

forming each of the first and second miniature building halves with a display base oriented generally horizontally in the display position and fixedly connected with the sidewall panel, the end panel, the transport base panel and the center wall panel to define at least a portion of the hollow interiors of the first and second miniature building halves.

* * * * *